United States Patent [19]

Kovacs, Mark S.

[11] Patent Number: 4,953,764

[45] Date of Patent: Sep. 4, 1990

[54] CONTAINER SYSTEM FOR MANAGING NAILS, SCREWS AND THE LIKE

[76] Inventor: Kovacs, Mark S., 117 Brookpine Dr., Apartment 2107, Columbia, S.C. 29210

[21] Appl. No.: 402,908

[22] Filed: Sep. 5, 1989

[51] Int. Cl.[5] ..... A45C 15/00; A45F 5/02; B25H 3/02; A47F 5/08

[52] U.S. Cl. ..... 224/151; 224/252; 224/269; 224/904; 312/245; 312/DIG. 33; 206/231; 206/338; 206/373; 206/806; 220/94 R

[58] Field of Search ..... 312/DIG. 33, 107, 109, 312/244, 246, 245; 206/373, 372, 379, 374, 338, 375, 318, 234, 231, 223, 349, 45.14, 45.19, 45.2, 45.23, 45.28, 806, 44 R; 220/23.83, 23.86, 94 R; 211/70.6, 88; 190/118, 114, 115, 117; 224/151, 230, 224–226, 252, 253, 269, 271, 904

[56] References Cited

U.S. PATENT DOCUMENTS

| | | | |
|---|---|---|---|
| 414,992 | 11/1889 | Paton | 206/45.28 |
| 837,824 | 12/1906 | Gibson | 224/252 |
| 872,619 | 12/1907 | Geyer | 190/118 |
| 875,452 | 12/1907 | Paine | 224/247 |
| 1,305,918 | 6/1919 | May | 43/54.1 X |
| 1,367,043 | 2/1921 | Haskell | 190/115 X |
| 1,882,756 | 10/1932 | Boynton | 312/DIG. 33 |
| 2,095,227 | 10/1937 | Brown | 312/245 |
| 2,120,234 | 6/1938 | Armstrong | 224/235 |
| 2,278,401 | 3/1942 | Micari | 224/252 X |
| 2,447,915 | 8/1948 | Sisk | 224/235 |
| 2,503,737 | 4/1950 | Hodgkins | 312/246 |
| 2,522,049 | 9/1950 | Lang | 206/45.19 X |
| 2,525,208 | 10/1950 | Clink | 312/107 |
| 2,604,959 | 7/1952 | Arbib | 312/244 X |
| 2,628,752 | 7/1953 | Corkish | 312/244 |
| 2,634,835 | 4/1953 | Mayers | 190/16 |
| 2,783,875 | 3/1957 | Shabarick | 312/DIG. 33 |
| 2,903,127 | 9/1959 | Dorman | 206/338 |
| 2,936,879 | 5/1960 | Downs | 206/45.19 |
| 3,023,891 | 3/1962 | Sutter | 206/231 |
| 3,275,336 | 9/1966 | Warner, Jr. | 190/115 |
| 3,327,841 | 6/1967 | Schurman et al. | 206/45.19 |
| 3,342,387 | 9/1967 | Ryan | 224/252 |
| 3,351,183 | 11/1967 | Sammarco | 206/45.2 |
| 3,399,484 | 9/1968 | Marks | 43/55 |
| 3,578,153 | 5/1971 | Olson | 206/372 |
| 3,640,420 | 2/1972 | Carter et al. | 206/349 |
| 3,744,864 | 7/1973 | Schmitz | 312/244 |
| 4,119,181 | 10/1978 | Jones | 206/223 |
| 4,160,570 | 7/1979 | Bridges | 312/245 |
| 4,201,292 | 5/1980 | Davidson et al. | 206/44 R |
| 4,323,181 | 4/1982 | Spasoff | 43/55 X |
| 4,561,705 | 12/1985 | Schafer | 312/244 |
| 4,576,307 | 3/1986 | Frydenberg | 190/117 X |
| 4,611,716 | 9/1986 | Sorlien | 206/806 X |
| 4,634,193 | 1/1987 | Liu | 312/244 |
| 4,747,527 | 5/1988 | Trumpower, II | 224/224 |

FOREIGN PATENT DOCUMENTS

| | | | |
|---|---|---|---|
| 0454328 | 12/1926 | Fed. Rep. of Germany | 190/115 |
| 0144962 | 4/1954 | Sweden | 312/245 |

*Primary Examiner*—Henry J. Recla
*Assistant Examiner*—Casey Jacyna
*Attorney, Agent, or Firm*—Michael A. Mann

[57] ABSTRACT

A system for use with small objects such as nails, screws and the like comprises a box dimensioned to hold a plurality of curved, lidded containers that fit easily into a carpenter's pouch or, alternatively, have a clip for use directly on a work belt. The top and the bottom of the box are latched and carried by a handle with two axes of rotation, one for unlatching and one for moving to a noninterfering position when the box is mounted to a wall to serve as a temporary shelf. The handle latches securely, both by mating with a portion of the bottom of the box and by sleeves that slide over a portion of the handle. Each container may also have an integral or removable divider for holding complementary small objects in the left and right portions of the container.

14 Claims, 3 Drawing Sheets

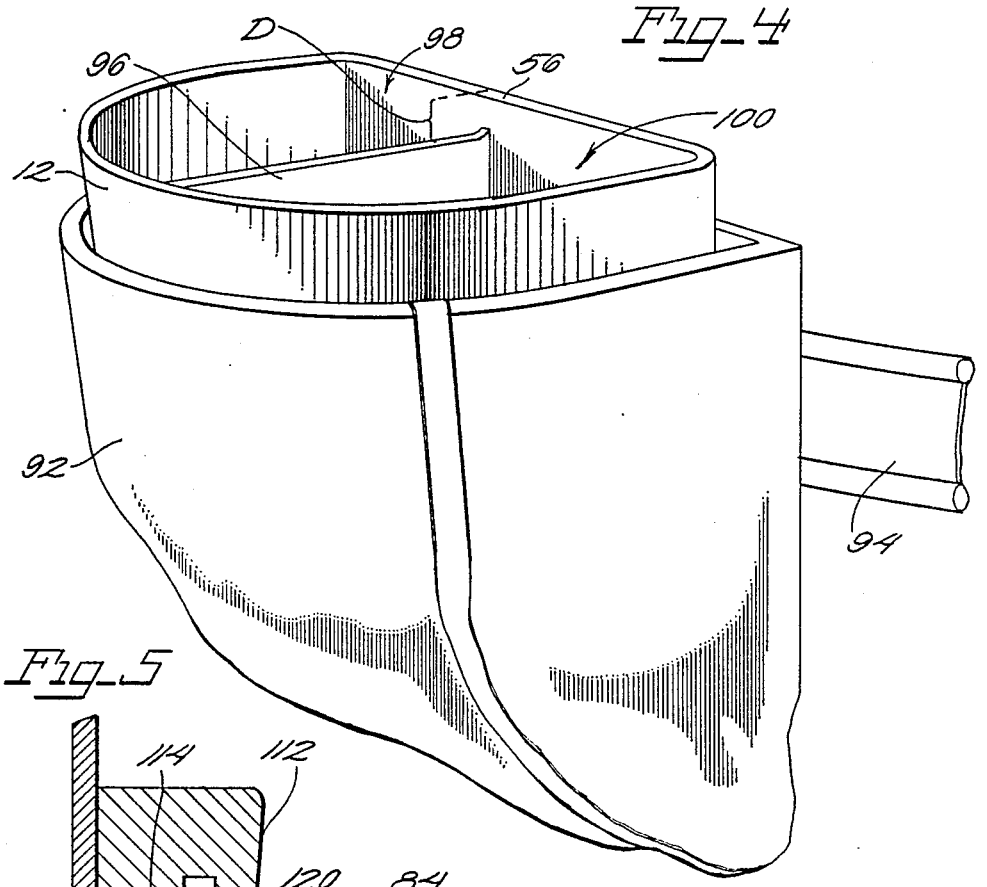
Fig_4
D
98
96
56
100
12
92
94
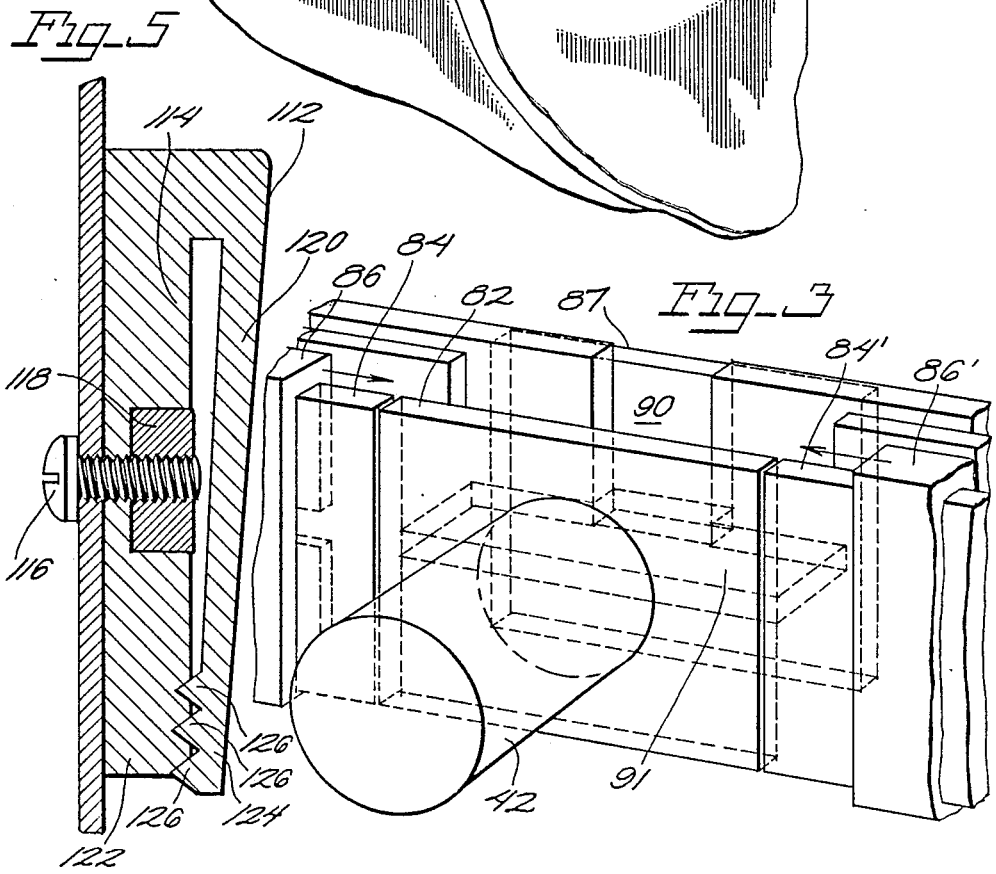
Fig_5
114
112
120
118
116
126
126
126
124
122
Fig_3
86
84
82
87
84'
86'
90
91
42

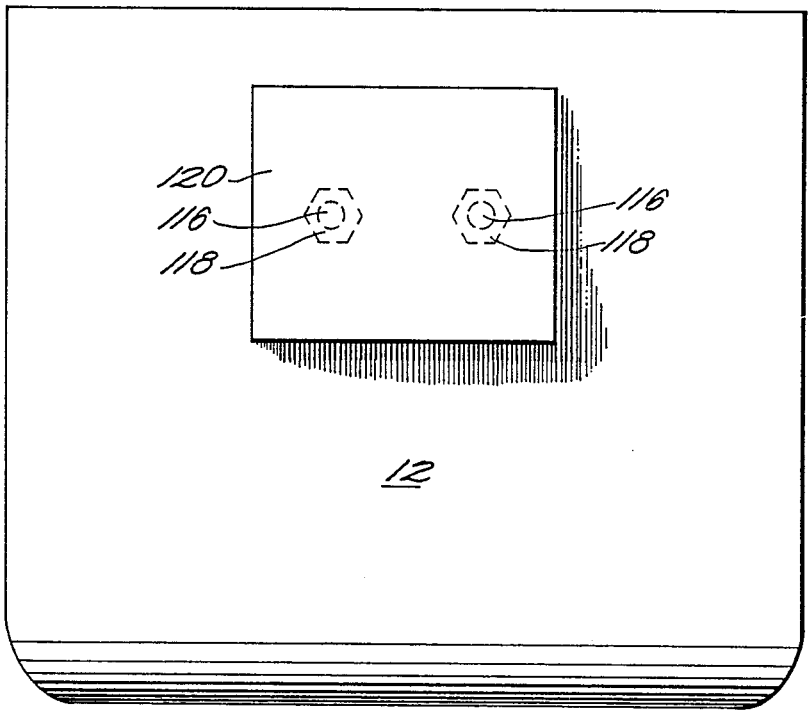
Fig. 6
Fig. 7
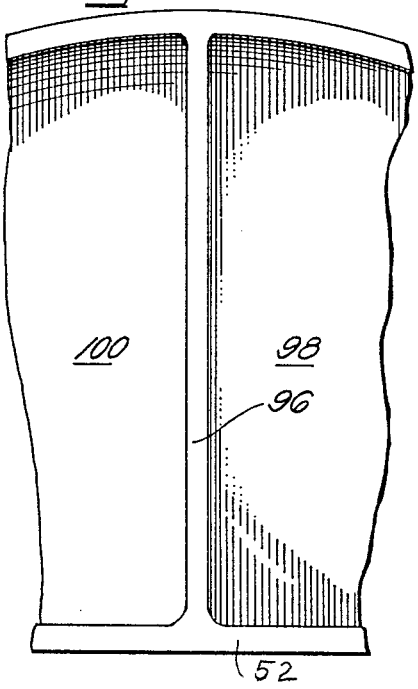
Fig. 8
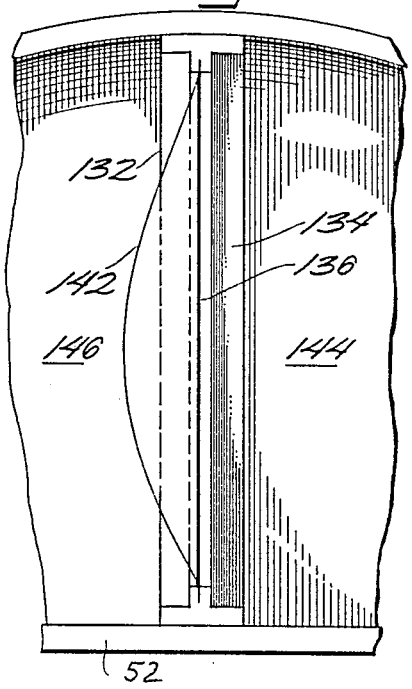

CONTAINER SYSTEM FOR MANAGING NAILS, SCREWS AND THE LIKE

BACKGROUND OF THE INVENTION

1. Field of the Invention:

The present invention relates to container systems for managing, nails, screws and the like.

2. Discussion of the Background:

Small items such as nails, screws, rivets, bolts, and nuts commonly used in large quantities in construction come in a variety of sizes. These small objects must be managed; that is, kept in a manner that they are not lost or comingled and can be easily used. Currently, many users of these small objects use jars or cans for storing these objects and a standard "carpenter's pouch" on a work belt for holding a ready supply for immediate use. A carpenter's pouch is a canvas or leather bag, sometimes with more than one compartment, that can be filled with nails, screws and the like. The carpenter's pouch flattens for storage but will bulk out when filled. Filling involves dumping a supply of the objects of choice into the pouch while holding the pouch open. When the last few nails or screws are left in the pouch, they cannot be easily seen without holding the pouch open. Alternatively, gropping in the bottom of the pouch for these last items can result in scratches to the fingers of the user.

Containers are of course well known as are boxes for storing a number of individual containers. See for example liu's Cabinet for storing Small Parts Such As Bolts, Screws or the Like, U.S. Pat. No. 4,634,193. Also well known are belts and "kits" for small items such as Sisk's Stapling Kit, U.S. Pat. No. 2,447,915, and Trumpower, II's Utility Belt, U.S. Pat. Pat. 4,747,527.

However, there is a need for a system for managing small objects that provides not only storage for a variety of objects in a secure and convenient manner but also allows use of those objects in conjunction either with a carpenter's pouch or work belt.

SUMMARY OF THE INVENTION

In accordance with its major aspects, the present invention comprises in combination a container having a container body with a curved interior, a rim at the top of the container body, and a lid that is removably fastened to the rim, and a storage box having a top and a bottom hinged together. The box is dimensioned to store a number of the containers and adapted to serve as a storage shelf for such containers or as a carrying case. The containers are provided with a removable clip for attaching the container to a belt and are curved on the exterior to slide easily into a carpenter's pouch. The storage box has preferably a handle that serves as a means to carry the box and latch the top and the bottom together. The handle is preferably designed to rotate about two different axes, one to latch and unlatch the box and the other to move the handle to a noninterfering position. Inside the box is preferably a cushioned member against the back of the bottom that has recesses contoured to receive and hold small tools such as punches, drill bits, chuck keys, and the like. The containers are also preferably furnished with a divider, most preferably a removable divider, so that two different types of small objects can be put into either a left and a right portion of the same container.

It is a feature of the invention that the containers can be removed from the storage box and placed directly into a carpenter's pouch; then, when the work is done, the containers can be returned to the storage box, the lids attached and the box latched. The storage box with a number of containers each holding a different type of small object can betaken to a work site or removably mounted to a wall of a shop as a shelf. The advantage of this feature is that the small objects do not have to be transferred by pouring or dumping from storage container to carpenter's pouch.

It is another feature of the invention that the handle latches the top and bottom of the box in two ways, to assure that the top and bottom are securely fastened. Because of the weight of the box when all the containers are filled with nails, screws and the like, double latching is an important advantage.

It is another feature of the invention that the containers, being curved and firm, fit into a carpenter's pouch easily and in such a way the the pouch is held open so that the objects are visible and more easily accessible.

It is still another feature of the invention that the interior of the containers is curved with the advantage of easier removal of objects from the containers with the fingers.

It is yet another feature of the invention that the containers have clips for attaching directly to a belt if the user does not have a carpenter's pouch.

It is yet another feature of the invention that the storage box has a handle that serves both the purpose of latching the box and as a means to carry the box when the handle is latched. The advantage of this feature is the simplification of construction of the box.

The present invention can be better appreciated by reference to the following detailed description of a preferred embodiment of the present invention, which is also illustrated in the accompanying drawings that are described below.

BRIEF DESCRIPTION OF THE DRAWINGS

FIG. 3 is a detailed, perspective view of the latching sleeves of the handle according to the present invention.

FIG. 4 is a perspective view of the container sliding into a carpenter's pouch according to an embodiment of the present invention.

FIG. 5 is a detailed side-cross sectional view of the container showing the clip for attaching the container directly to a work belt according to the present invention.

FIG. 6 is a rear view of a container with a clip according to the present inventon.

FIG. 7 is a detailed top view of the container with an integral divider according to the present invention.

FIG. 8 is a detailed top view of the container with an alternative embodiment of the divider according to the present invention.

DETAILED DESCRIPTION OF A PREFERRED EMBODIMENT

The present invention comprises a system for use with small objects such as nails, tacks, screws, bolts, nuts, washers and the like, comprising containers that can be clipped to a work belt or slipped into a carpenter's pouch attached to a work belt and a means for storing the containers, such as a box dimensioned to store a number of such containers when those containers are not worn on a belt.

Figure 1:
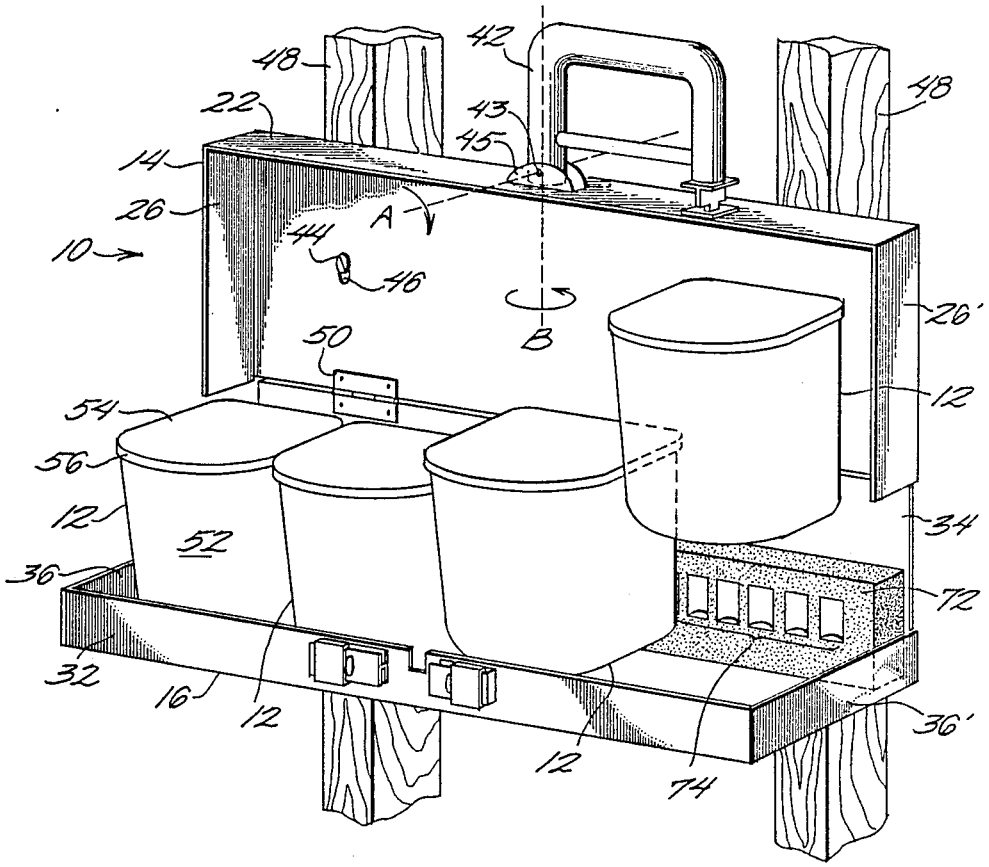
FIG. 1 is a perspective view according to the system of the present invention showing the box in the open position as a shelf with four containers, one slightly elevated, the other more elevated.

Referring now to FIG. 1, the storage means is shown as a box 10 having a four containers 12 therein. Box 10 has an upper portion or top 14 and a lower portion or bottom 16. Top has a front 22 and two sides 26 and 26'. Bottom 16 has a front 32, a back 34 and two sides 36 and 36'.

Attached to top 14 is a handle 42 which serves to carry box 10 and as to latch box 10 when containers 12 are to be secured therein. Handle 42 pivots about two axes, a first axis A and a second axis B. Handle 42 pivots about axis A by a pivot pin 43 through handle 42 and bracket 45 to move from a latching position to an unlatching position and about axis B to move to a noninterfering position when, as illustrated in FIG. 1, box 10 is mounted on a wall or a pair of studs 48 on a shop wall by means of screws 44 through slots 46 in top 16 to serve as a shelf for containers 12 or any other type of container, especially a tippable container. A tippable container is a container that can be turned over easily because of its shape.

Top 14 and bottom 16 are preferably attached to each other by means of hinges 50, especially if box 10 is made of metal, preferably a noncorrosive, non rusting metal. Alternatively, box 10 may be made of a study grade of plastic with top 14 and bottom 16 integrally but flexibly connected.

Each container 12 has a container body 52 and a removable lid 54, preferably a lid that snaps securely to a flanged rim 56 about the upper portion of container body 52. Behind containers 12, along back 34 of bottom 16 is a member 72, preferably made of a resilient material such as foam, having a plurality of recesses 74 dimensioned and shaped for holding small tools such as drill bits, punches, chuck keys, taps and the like. Member 72 is preferably dimensioned so that it fits between container body 52 and back 34.

Figure 2:
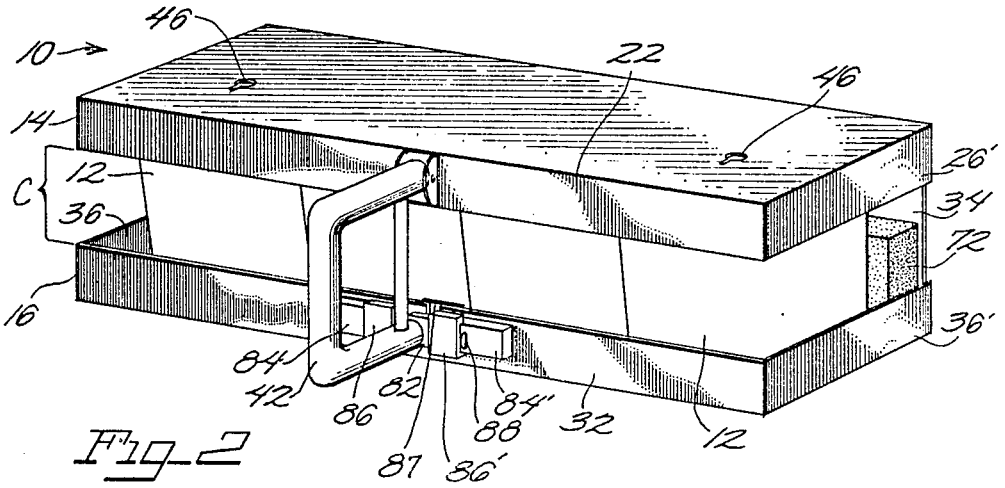
FIG. 2 is a perspective view according to the system of the present invention showing the box closed, four containers therein and the handle in carrying position.

As seen in FIG. 2, when top 14 and bottom 16 are latched by handle 42, there is preferably a gap C therebetween so that the presence and number of containers 12 can be easily seen, yet containers cannot slip out of box 10.

Handle 42 latches to bottom 16 in the following manner best seen in FIGS. 2 and 3. At the end of handle 42 is a first rail 82 that aligns with rails 84, 84' attached to front 32 of bottom 16. Two sleeves 86 and 86' ride on rails 84, 84' and are brought close to handle 42, held generally in place by raised portions 88 on either side of handle 42 on rail 84 to secure first rail 82 to rail 84, 84' as sleeves 86 and 86' wrap around rails 82 and 84, 84'. Connected to handle 42 is a second rail 87 which is positioned behind front 32, notched at 90 so that second rail 86 and first rail are attached, the two together and their connecting portion, suggested by dashed lines in FIG. 3 at 91, form an "T" beam, with second rail behind front 32 and first rail 82 in front of front 32. Thus handle 42 is doubly secures top 14 and bottom 16.

Containers 12 are dimensioned and shaped to slide easily into a carpenter's pouch 92 which is worn on a work belt 94. Pouch 92 is usually made of canvas and, when container 12 is placed therein, expands to conform to the shape of the container thereby the contents of the container are easily seen. The curved interior of container 12 facilitates removal of the last of the small objects in the container. Container 12 may be fitted with a divider 96 to divide container 12 into a left portion 98 and a right portion 100, especially advantageous when complementary small objects such as bolts and nuts are required for a purpose. The top of divider 96 is preferably below the rim 56 a distance D so that the fingers of the user can reach to the bottom of container 12 easily. Divider 96 is more fully described below.

For users who do not use a carpenter's pouch, container 12 is preferably equiped with a clip 112 shown in FIGS. 5 and 6, side and back views of container 12, respectively. Clip is preferably constructed of a single material in genrally an inverted "U" shape with a first portion 114 adjacent container body 52 and held in place with preferably bolts 116 and nuts 118 so that it is firmly but removably attached, or, alternatively, permanently attached or integral with container body 52. Clip 112 has a second, thinner portion 120 generally parallel to first portion 114. At the ends 122 and 124 of first portion 114 and second portion 120, respectively are teeth 126 for secure, nonsliding grip to a work belt. Preferably clip 112 is mounted near the top of container 12 and is wide enough to encompass most wide work belts.

Divider 96 may be integral to container body 52 as shown in FIG. 7, or may be removable. An embodiment of a removable divider 132 is shown in FIG. 8 which comprises a "U" shaped member 134 fitted into interior of container 12. Member 134 has a slot 136 fitted with a membrane 142 having enought slack to move laterally when the user's hand is inserted. Container 12 is thus divided into a left 144 and a right portion 146. Member 134 can ba snap-fitted into positon by any convenient means or glued, as desired.

Box 10, in addition to wall mounting, can be carried to a work site using handle 42, unlatched, and one of containers 12 removed, inserted into a carpenter's pouch, used, and returned to box 10 without the need to transfer nails from one container to another. Each container can hold a different type of nail or other small object, or some of the containers could hold more than one type if equiped with a divider. Boxes may be stacked, as convenient.

The presently preferred embodiment of the present invention has been shown and described with a degree of particularity, but it should be understood that the scope of the invention is defined in the following claims.

I claim:

1. A system for use with small objects, such as nails, screws and the like, comprising:

a plurality of containers dimensioned for holding a multiplicity of said small objects; and a means for storing said plurality of containers, said containers each having a container body with a curved interior and a rim, and a lid removably attachable to said container body, said container body and said lid removable from said storing means, said storing means having a lower portion dimensioned for said plurality of containers, an upper portion opposing said lower portion, said lower portion hingedly attached thereto about a first axis on one side of said storing means to said upper portion, and means for latching an opposing side of said storing means, said upper portion latched to said lower portion, said latching means having a carrying handle pivotally attached to said storage means, said carrying handle pivoting about a second axis from a latching position to an unlatching position and further pivoting about a third axis perpendicular to said first axis from said unlatching position to a noninterfering position with respect to said storing means.

2. The system of claim 1 wherein said containers are dimensioned and shaped to fit into a carpenter's pouch.

3. The system of claim 1 wherein each of said containers has a clip adapted for attaching said container to a belt.

4. The system of claim 3, wherein said clip is removably attachable to said container.

5. The system of claim 3, wherein said clip further comprises:

a first portion having a first end;

a second portion integral with and extending from said first portion in an inverted "U" shape, said second portion generally parallel to said first portion and having a second end, said first end of said first portion and said second end of said second portion having teeth which interlock for secure, nonsliding grip to a belt; and means to removably attach said clip to said container.

6. The system of claim 5, wherein said attaching means is located within said first portion of said clip.

7. The system of claim 1 wherein said container body has a divider for separating said container into a right portion and a left portion.

8. The system of claim 7 wherein said divider has a top spaced below the top of said container body so that the fingers of the user when inserted into either left or right portion of said container reach any of said small objects in said left or right portion.

9. The system of claim 8 wherein said divider is integral with said container body.

10. The system of claim 8 wherein said divider further comprises:

a flexible member fitted into said interior of said container body in a U-shape; and a membrane attached to said flexible member, said membrane movable laterally from the portion wherein the fingers of the user are inserted.

11. The system of claim 1 wherein said lower portion further comprises a bottom, a front, two sides and a back, said front, said two sides and said back of said lower portion attached to said bottom, and said upper portion further comprises a top, a front, two sides and a back, said front, said two sides and said back of said upper portion attached to said top, said back of said upper portion hingedly attached to said back of said lower portion, and said latching means latching said front of said lower portion to said front of said upper portion.

12. The system of claim 11 wherein said storing means has at least two slots in said top of said upper portion for mounting said storing means on a wall so that said storing means serves as a shelf for tippable containers.

13. The system of claim 11 wherein said storing means further comprises a member attached to said back of said lower portion, interior to said lower portion, said member having a plurality of recesses dimensioned to accomodate and to hold small tools, said member dimensioned to fit between said container bodies and said lower portion.

14. The system of claim 1, wherein said storing means has at least two slots in said upper portion for use in mounting said storing means on a wall.

* * * * *